US007140274B2

(12) United States Patent
Foster

(10) Patent No.: US 7,140,274 B2
(45) Date of Patent: Nov. 28, 2006

(54) APPARATUS AND METHOD FOR RESETTING A FASTENER

(76) Inventor: Doug Foster, 9620 Gage St., Elk Grove, CA (US) 95624

( * ) Notice: Subject to any disclaimer, the term of this patent is extended or adjusted under 35 U.S.C. 154(b) by 0 days.

(21) Appl. No.: 10/775,673

(22) Filed: Feb. 10, 2004

(65) Prior Publication Data

US 2005/0172759 A1 Aug. 11, 2005

(51) Int. Cl.
*B25D 1/16* (2006.01)
*B25D 1/00* (2006.01)

(52) U.S. Cl. ..... 81/27; 81/44; 227/147

(58) Field of Classification Search ..... 81/27, 81/20, 44, 463; 7/143; 227/113, 139, 147, 227/142, 146; 173/90
See application file for complete search history.

(56) References Cited

U.S. PATENT DOCUMENTS

| | | | | | |
|---|---|---|---|---|---|
| 722,559 | A | * | 3/1903 | Bond | 81/44 |
| 839,246 | A | | 12/1906 | Williams | |
| 2,475,041 | A | | 7/1949 | Mattson | |
| 3,901,298 | A | * | 8/1975 | Eby | 81/27 |
| 4,008,741 | A | | 2/1977 | Holstein | |
| 4,241,795 | A | | 12/1980 | Landry, Jr. | |
| 4,252,259 | A | | 2/1981 | Brosius | |
| 4,299,021 | A | * | 11/1981 | Williams | 227/147 |
| 4,354,540 | A | * | 10/1982 | Jefferson | 81/44 |
| 4,437,602 | A | | 3/1984 | Kaczmarek | |
| 4,470,440 | A | | 9/1984 | Thor | |
| 4,610,188 | A | * | 9/1986 | Hallock | 227/113 |
| 4,676,424 | A | * | 6/1987 | Meador et al. | 227/147 |
| 5,085,281 | A | | 2/1992 | Selly | |
| 5,095,735 | A | | 3/1992 | Schneider, Jr. | |
| 5,370,192 | A | | 12/1994 | Evinger | |
| 5,741,268 | A | * | 4/1998 | Schutz | 227/146 |
| 5,816,341 | A | | 10/1998 | Bone et al. | |
| 6,125,719 | A | | 10/2000 | Lowther | |
| 6,301,996 | B1 | | 10/2001 | Crawford | |
| 6,349,618 | B1 | | 2/2002 | Lowther | |
| 6,415,468 | B1 | * | 7/2002 | Spaur | 7/143 |
| 6,474,198 | B1 | | 11/2002 | Lowther | |
| 2004/0164122 | A1 | * | 8/2004 | Borkowski | 227/147 |

* cited by examiner

*Primary Examiner*—D. S. Meislin
(74) *Attorney, Agent, or Firm*—Tope-McKay & Associates

(57) ABSTRACT

The present invention relates to an impact tool, and more particularly, to an apparatus and method for resetting a fastener that allows a force from an impact member to be transferred to the fastener in order to reset the fastener below a surface plane of a material. The apparatus comprises an impact member connected with a guide member, such that the impact member is freely slideable in relation to the guide member between a retracted position and an extended position. A user may reset the fastener by forcing the impact member from the retracted position to the extended position, where a portion of the impact member is extended beyond the guide member to come into contact with the fastener and thereby reset the fastener below the surface plane of the material.

3 Claims, 6 Drawing Sheets

APPARATUS AND METHOD FOR RESETTING A FASTENER

FIELD OF INVENTION

The present invention relates to an impact tool, and more particularly, to an apparatus and method for resetting a fastener that allows a force from an impact member to be transferred to the fastener in order to reset the fastener below a surface plane of a material.

BACKGROUND OF INVENTION

Impact tools used for resetting fasteners have long been known in prior art. For example, in the process of installing sheetrock, an installer often fails to set a fastener below a surface of the sheetrock, thereby leaving a head of the fastener exposed beyond the surface. This particular problem may occur when installing sheetrock on both walls and ceilings. When the fastener is exposed beyond the surface of the sheetrock, the installer must return to each fastener in order to reset it. When this particular problem occurs on walls, an ordinary impact tool such as a hammer may be used to reset the fastener properly. However, when a fastener in the ceiling needs to be reset, the installer must position a bench or ladder beneath each unset fastener in order to reach the ceiling and the respective fastener. Because an installer must reposition the bench or ladder beneath each unset fastener, utilizing tools currently available for resetting fasteners can be very time consuming. Therefore, it can be appreciated that there exists a continuing need for a tool allowing a user to reset fasteners on the ceiling from a ground surface without the use of a bench or ladder. In this regard, the present invention substantially fulfills this need.

SUMMARY OF INVENTION

The present invention relates to an impact tool, and more particularly to an apparatus for resetting a fastener that allows a force from an impact member to be transferred to the fastener in order to reset the fastener below a surface plane of a material. The apparatus comprises a guide member and an impact member, where the impact member has retracted position and an extended position. The guide member has a distal end and a proximal end. The guide member further comprises a length with a guide member axis therethrough and a distal stop positioned proximate the distal end and a proximal stop positioned proximate the proximal end.

The impact member has a length and an impact member axis residing along the length. The impact member is attached with the guide member such that the impact member axis is aligned with the guide member axis. The impact member further comprises a striking portion with a striking portion diameter and a proximal portion with a proximal portion diameter, where the striking portion diameter is less than the proximal portion diameter. The impact member is further positioned between the proximal stop and the distal stop, such that the impact member is freely slideable in relation to the guide member between the proximal stop and the distal stop.

The extended position is defined by the distal stop, occurring when the striking portion of the impact member is extended beyond the distal end of the guide member. The retracted position is defined by the proximal stop, occurring when the striking portion of the impact member is retracted below the distal end of the guide member.

A user may reset the fastener by first using the distal end of the guide member as an alignment tool to align the retracted impact member with a fastener by placing the guide member over the fastener. The user thereafter forces the impact member from the retracted position to the extended position, where the striking portion of the impact member is extended beyond the distal end of the guide member to come into contact with the fastener and thereby reset the fastener below a surface plane of a material.

In another aspect, the striking portion of the impact member has a head portion with edges, wherein the edges of the head portion are beveled.

Furthermore, the distal end of the guide member has an outer surface and the outer surface further comprises a rubber surface engager attached with the outer surface.

Additionally, the apparatus further comprises a retractor positioned between the impact member and the guide member such that a retracting force from the retractor forces the impact member from the extended position to the retracted position.

In yet another aspect, the apparatus further comprises an extender positioned between the impact member and the guide member such that an extending force from the extender forces the impact member from the retracted position to the extended position.

A cock and release mechanism may be attached with the impact member, whereby a user may retract the impact member where it is held in place by the cock and release mechanism. The user may thereafter release the impact member through use of the same mechanism, where the impact member is thereafter forced to an extended position by the extending force of the extender.

In another aspect, the proximal portion has an outer end with an attachment portion connected with the outer end, whereby a user may attach an extension with the attachment portion and utilize the extension to force the guide member from the retracted position to the extended position.

Moreover, the apparatus further comprises a handle pole attached with the proximal portion, where the handle pole extends beyond the proximal end of the guide member. The handle pole further comprises a sliding attachment portion whereby a user may attach a tool with the sliding attachment portion, allowing the user to reset a fastener through use of the guide member and impact member, or alternatively, turn the apparatus around to utilize the attached tool. The handle pole may also comprise at least two poles, an alignment pole and a sliding pole, where the alignment pole is selectively connected with the sliding pole through use of an adjustment lock.

In another aspect, the present invention relates to a method for resetting a fastener below a surface plane of a material. The method comprises acts of: locating an unset fastener; placing a guide member over the unset fastener; and causing the impact member to strike the fastener.

In placing a guide member over the unset fastener, the guide member has a distal end and a proximal end. The guide member further comprises a length with a guide member axis therethrough and a distal stop positioned proximate the distal end and a proximal stop positioned proximate the proximal end.

In causing the impact member to strike the fastener, the impact member has a length and an impact member axis residing along the length. The impact member is attached with the guide member such that the impact member axis is aligned with the guide member axis. The impact member further comprises a striking portion with a striking portion diameter and a proximal portion with a proximal portion diameter, where the striking portion diameter is less than the proximal portion diameter. The impact member is further positioned between the proximal stop and the distal stop, such that the impact member is freely slideable in relation to the guide member between the proximal stop and the distal stop, or between an extended position and a retracted position.

The extended position is defined by the distal stop, occurring when the striking portion of the impact member is extended beyond the distal end of the guide member. The retracted position is defined by the proximal stop, occurring when the entirety of the striking portion of the impact member is positioned between the distal end and the proximal end of the guide member. Causing the impact member to move from the retracted position to the extended position and thereby striking the fastener, resets the fastener below the surface plane of a material.

BRIEF DESCRIPTION OF THE DRAWINGS

The nature of the apparatus for resetting a fastener described herein will be readily apparent in the following drawings, in which.

DETAILED DESCRIPTION

The present invention relates to an impact tool, and more particularly, to an impact tool that allows a force from an impact member to be transferred to a fastener in order to reset the fastener below a surface plane of a material.

The following description, taken in conjunction with the referenced drawings, is presented to enable one of ordinary skill in the art to make and use the invention. Various modifications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

Figure 1:
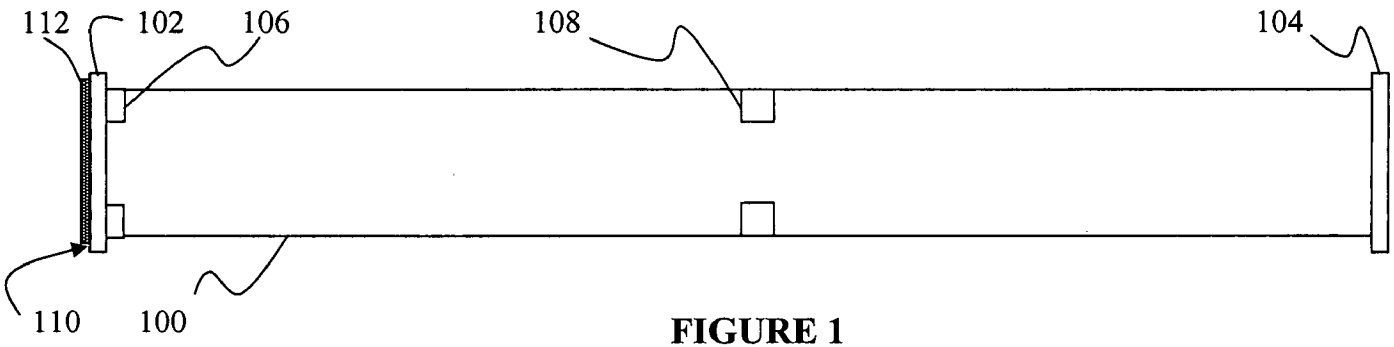
FIG. 1 is an illustration of a cross-sectional side view of a guide member according to the present invention.

FIG. 1 illustrates a guide member 100 according to the present invention. The guide member 100 is constructed of any suitably durable material, non-limiting examples of which include plastic and metal. The guide member 100 has a distal end 102 and a proximal end 104. Attached with the guide member 100 are at least two stops, a distal stop 106 attached near the distal end 102 and a proximal stop 108 attached near the proximal end 104. The stops may be any suitable mechanism or device for limiting travel of an object positioned therebetween, non-limiting examples of which include grommets and plastic protrusions. Furthermore, the distal end 102 of the guide member 100 has an outer surface 110. A surface engager 112 is attached with the outer surface 110 so that when the guide member 100 is placed against a ceiling surface, the surface engager 112 engages with the ceiling surface to prevent the guide member 100 from sliding around. The surface engager 112 is constructed of any suitable material for engaging with another material, a non-limiting example of which includes rubber.

Figure 2:
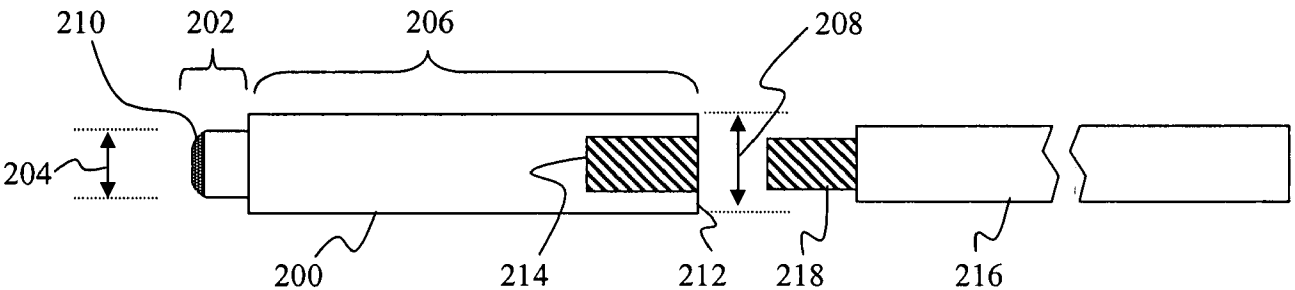
FIG. 2 is an illustration of a cross-sectional side view of an impact member according to the present invention.

FIG. 2 illustrates an impact member 200 according to the present invention. The impact member 200 is constructed of any suitably durable material, non-limiting examples of which include metal and plastic. Furthermore, the impact member 200 has a striking portion 202 with a striking portion diameter 204 and a proximal portion 206 with a proximal portion diameter 208. The striking portion diameter 204 is less than the proximal portion diameter 208. Both the striking portion diameter 204 and the proximal portion diameter 208 are measured as distances across their respective portions, whether the respective portion be square, round, or any other suitable shape. Additionally, the striking portion 202 has a head portion 210. The head portion 210 may be shaped in any in any suitable shape to allow a fastener to be reset below a surface plane of a material, a non-limiting example of which includes having beveled edges similar to that of a standard sheetrock hammerhead.

Furthermore, the proximal portion 206 has an outer end 212 with an attachment portion 214 connected with the outer end 212. The attachment portion 214 is formed such that a user may removably attach an extension 216 with the attachment portion 214. As a non-limiting example, the attachment portion 214 may be a female receptacle, where a male bit 218 of the extension 216 allows the extension 216 to be screwed into the attachment portion 214. Additionally, the extension 216 may be any suitable mechanism or device for extending an operable length of the impact member 200, non-limiting examples of which include an extension pole and broomstick.

Figure 3:
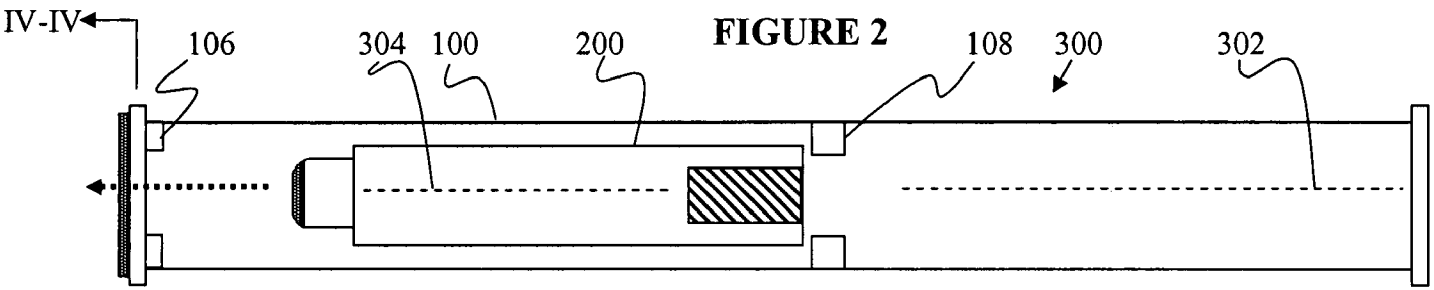
FIG. 3 is an illustration of a cross-sectional side view of an impact member connected with a guide member according to the present invention.

FIG. 3 illustrates the apparatus 300 with the impact member 200 housed within the guide member 100. The guide member 100 has a length with a guide member axis 302 therethrough and the impact member 200 has a length with an impact member axis 304 residing along the length. The impact member 200 is housed within the guide member 100 such that the impact member axis 304 is aligned with the guide member axis 302. Furthermore, the impact member 200 is positioned between the proximal stop 108 and the distal stop 106, such that the impact member 200 is freely slideable in relation to the guide member 100 between both stops.

Figures 4, 5, 6:
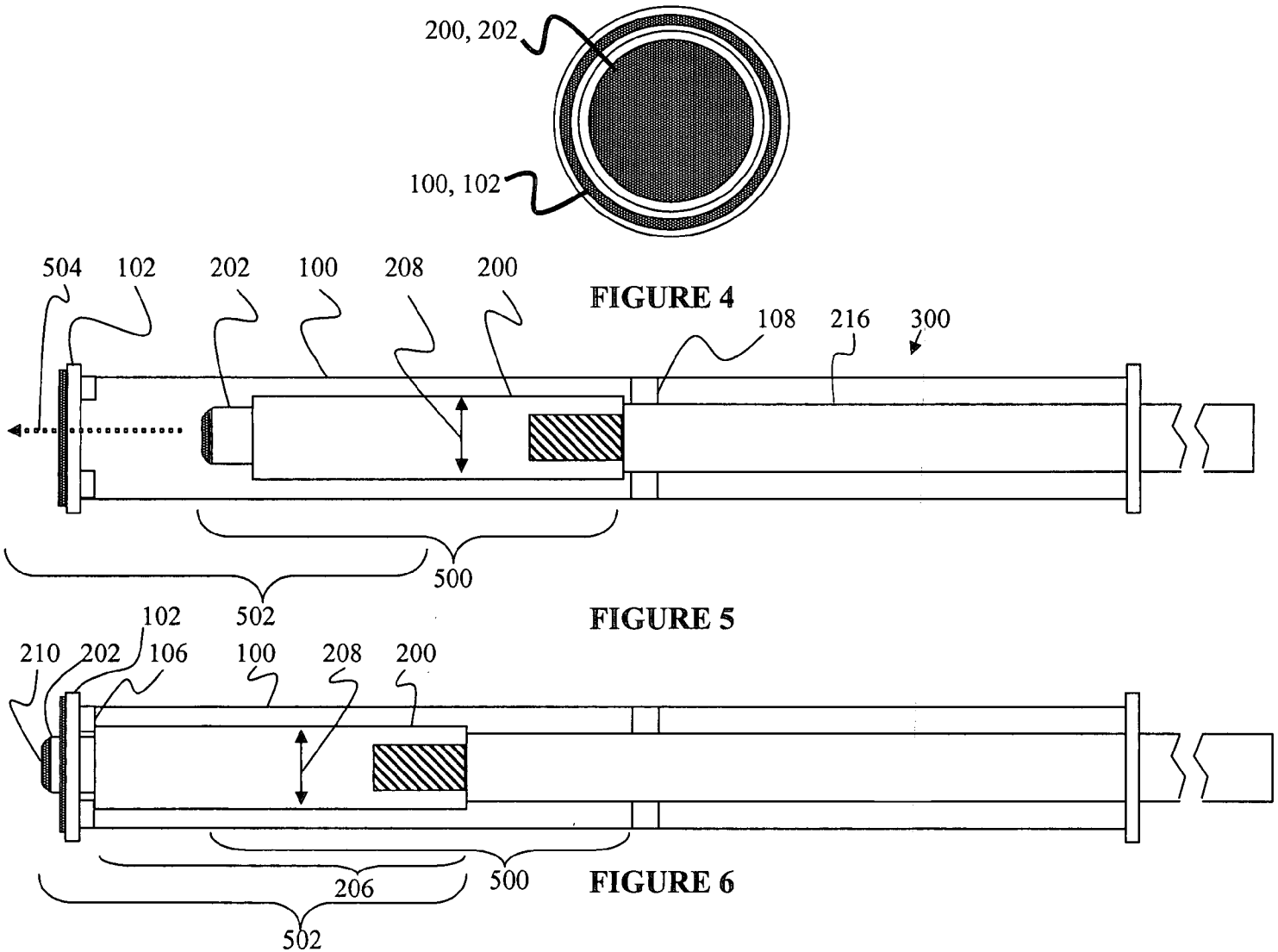
FIG. 4 is an illustration of a front view taken from line IV–IV of FIG. 3, of an impact member connected with a guide member according to the present invention.
FIG. 5 is an illustration of a cross-sectional side view of an extension connected with the impact member, where the impact member is in a retracted position.
FIG. 6 is an illustration of a cross-sectional side view of an extension connected with the impact member, where the impact member is in an extended position.

FIG. 4 is a front view of the distal end 102 of the guide member 100, taken from line IV–IV of FIG. 3. As shown in FIG. 4, the guide member 100 is constructed such that it does not obstruct the striking portion 202 of the impact member, allowing the striking portion 202 to be extended beyond the distal end 102 of the guide member 100.

FIG. 5 illustrates the extension 216 connected with the impact member 200. As shown in FIG. 5, the impact member 200 is in a retracted position 500. The limits of the retracted position 500 are defined by the proximal stop 108, where a width of the proximal portion diameter 208 prevents further movement of the impact member 200 beyond the proximal stop 108. When in the retracted position 500, the striking portion 202 of the impact member 200 is retracted below the distal end 102 of the guide member 100. Through use of the extension 216, a user may force the impact member 200 from the retracted position 500 to an extended position 502 by forcing the impact member 200 in a forward direction 504.

FIG. 6 illustrates the impact member 200 in the extended position 502. The limits of the extended position 502 are defined by the distal stop 106, where the width of the proximal portion diameter 208 prevents further movement of the proximal portion 206 of the impact member 200 beyond the distal stop 106. To be contrasted with the retracted position 500, when in the extended position 502, the head portion 210 of the striking portion 202 is extended beyond the distal end 102 of the guide member 100.

Figure 7:
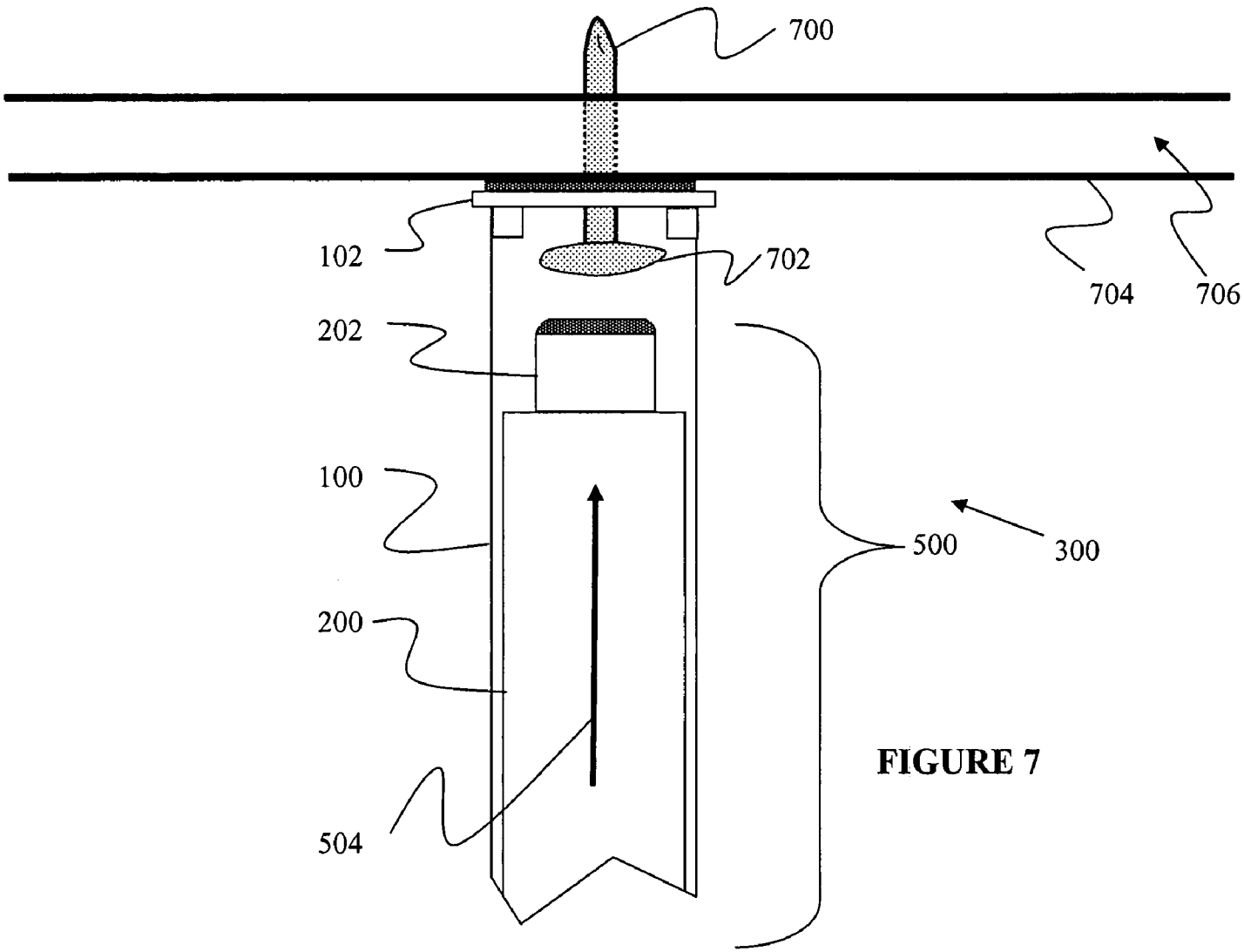
FIG. 7 is an illustration of a cross-sectional side view of the guide member engaged with a surface plane of a material with a fastener that needs resetting, where the impact member is in an retracted position.

FIG. 7 illustrates the apparatus 300 in use where the impact member 200 is in the retracted position 500. As shown in FIG. 7, a user may easily use the apparatus 300 by first locating a fastener 700 that needs resetting. The fastener 700 may be any suitable fastening device, such as a sheetrock screw or nail. A fastener 700 that needs to be reset is a fastener 700 whose head 702, or at least a portion of the fastener 700, extends beyond a surface plane 704 of a material, a non-limiting example of which includes a sheetrock nail whose head 702 extends beyond the surface plane 704 of the sheetrock. In the retracted position 500, the striking portion 202 of the impact member 200 rests below the distal end 102 of the guide member 100, thereby allowing a user to place the distal end 102 of the guide member 100 over the head 702 of the fastener 700. Once the guide member 100 is placed over the head 702 of the fastener 700, a user may force the impact member 200 in the forward direction 504 to strike the fastener 700 and reset the head 702 of the fastener 700 below the surface plane 704 of the material 706.

Figure 8:
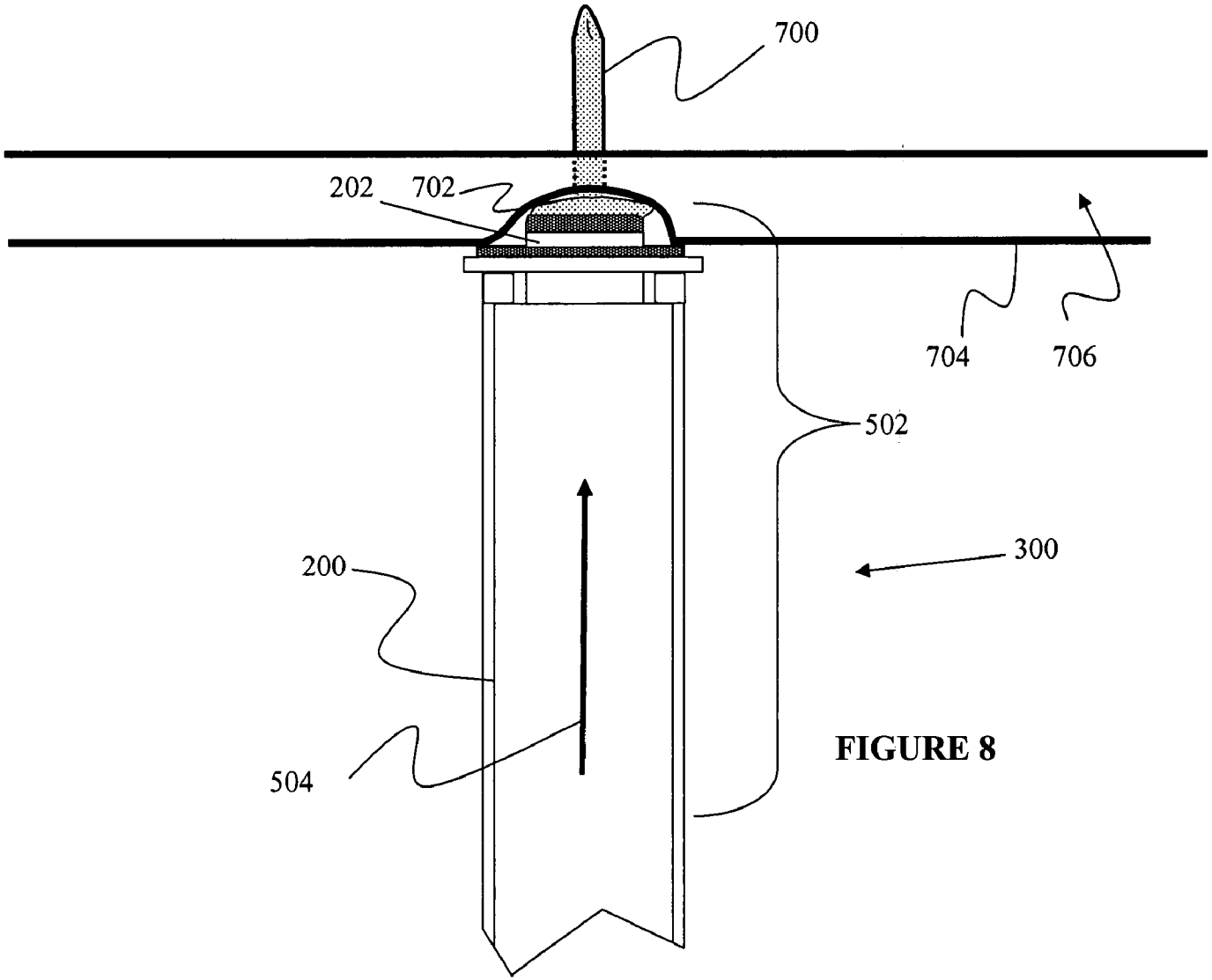
FIG. 8 is an illustration of a cross-sectional side view of the guide member engaged with a surface plane of a material with a fastener that has been reset, where the impact member is in an extended position.

FIG. 8 illustrates the apparatus 300 in use where the impact member 200 is in the extended position 502. As shown in FIG. 8, through moving the impact member 200 in the forward direct 504, the striking portion 202 strikes the fastener 700 and forces a portion of the fastener 700, such as the head 702, below the surface plane 704 of the material 706.

Through use of the apparatus 300, a user may easily reset fasteners 700 on the ceiling from the ground without the use of bench or ladder. As shown in FIGS. 7 and 8, the user simply places the guide member 100 over the head 702 of a fastener 700 and holds the guide member 100 firmly against the ceiling material 706. With another hand, the user forces the impact member 200 in the forward direction 504 to reset the fastener 700 below the surface plane 704 without breaking or damaging the material 706.

Figure 9:
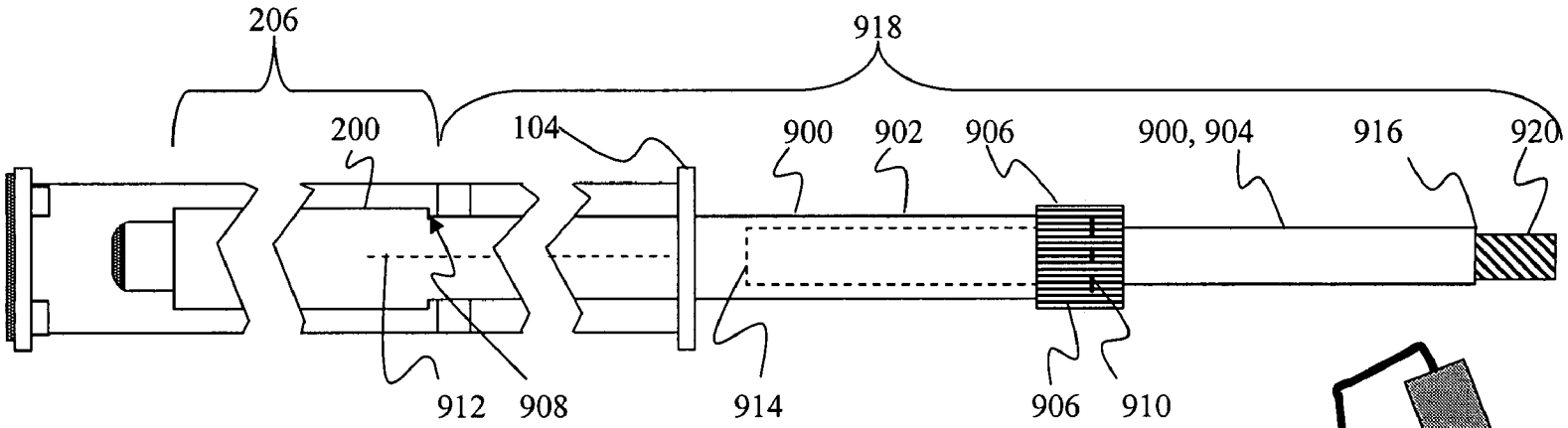
FIG. 9 is an illustration of a cross-sectional side view of a handle pole connected with the impact member.

FIG. 9 illustrates another aspect of the apparatus 300 according to the present invention. In this aspect, a handle pole 900 is permanently attached with proximal portion 206 of the impact member 200. The handle pole 900 is to be contrasted with the extension 216 of FIG. 2, where the extension 216 is removably attachable with the impact member 200.

Additionally, the handle pole 900 extends beyond the proximal end 104 of the guide member 100, allowing a user to control the impact member 200 through use of the handle pole 900. Furthermore, the handle pole 900 may be comprised of at least two poles, an alignment pole 902 and a sliding pole 904. The alignment pole 902 is connected with the sliding pole 904 through use of an adjustment lock 906. The alignment pole 902 is in a fixed position in relation to the impact member 200, whereas the sliding pole 904 may be adjusted in relation to the impact member 200.

The alignment pole 902 has an alignment first end 908, an alignment second end 910, and a length with an alignment axis 912 therethrough. The alignment pole 902 may be any suitable mechanism or device for maintaining an alignment of an object, a non-limiting example of which includes a cylindrical tube.

The sliding pole 904 is in a fixed parallel alignment with the alignment axis 912 of the alignment pole 902. The sliding pole 904 may be any suitable mechanism or device for extending a length of the handle pole 900, a non-limiting example of which includes a cylindrical tube. The sliding pole 904 has a sliding first end 914 and a sliding second end 916 and is connected with the alignment pole 902 such that a length 918 of the handle pole 900 is adjustable by sliding the alignment second end 910 of the alignment pole 902 between the sliding first end 914 and sliding second end 916 of the sliding pole 904. As a non-limiting example, the sliding pole 904 is a cylindrical tube and is positioned within a larger cylindrical tube of the alignment pole 902, allowing the two poles to be slid past each other and thereby vary the length 918 of the handle pole 900.

Once the length 918 of the handle pole 900 is set at a desired length, the two poles may be locked in relation to each other through use of the adjustment lock 906, thereby preventing the aforementioned sliding action. The adjustment lock 906 may be any suitable mechanism or device for locking and unlocking one object against another, non-limiting examples of which include a wedge shaped inner sleeve with threads and an outer sleeve to engage with the threads, and a click and release mechanism. Through selectively locking and unlocking the adjustment lock 906, the length 918 of the handle pole 900 may be adjusted to be set at the desired length.

Furthermore, a sliding attachment portion 920 is attached with the sliding second end 916 of the sliding pole 904. The sliding attachment portion 920 is formed such that a user may removably attach an object with the sliding attachment portion 920. As a non-limiting example, the sliding attachment portion 920 may be a male bit, where the male bit may be screwed into a female receptacle of a tool, such as a paint roller.

Figure 10:
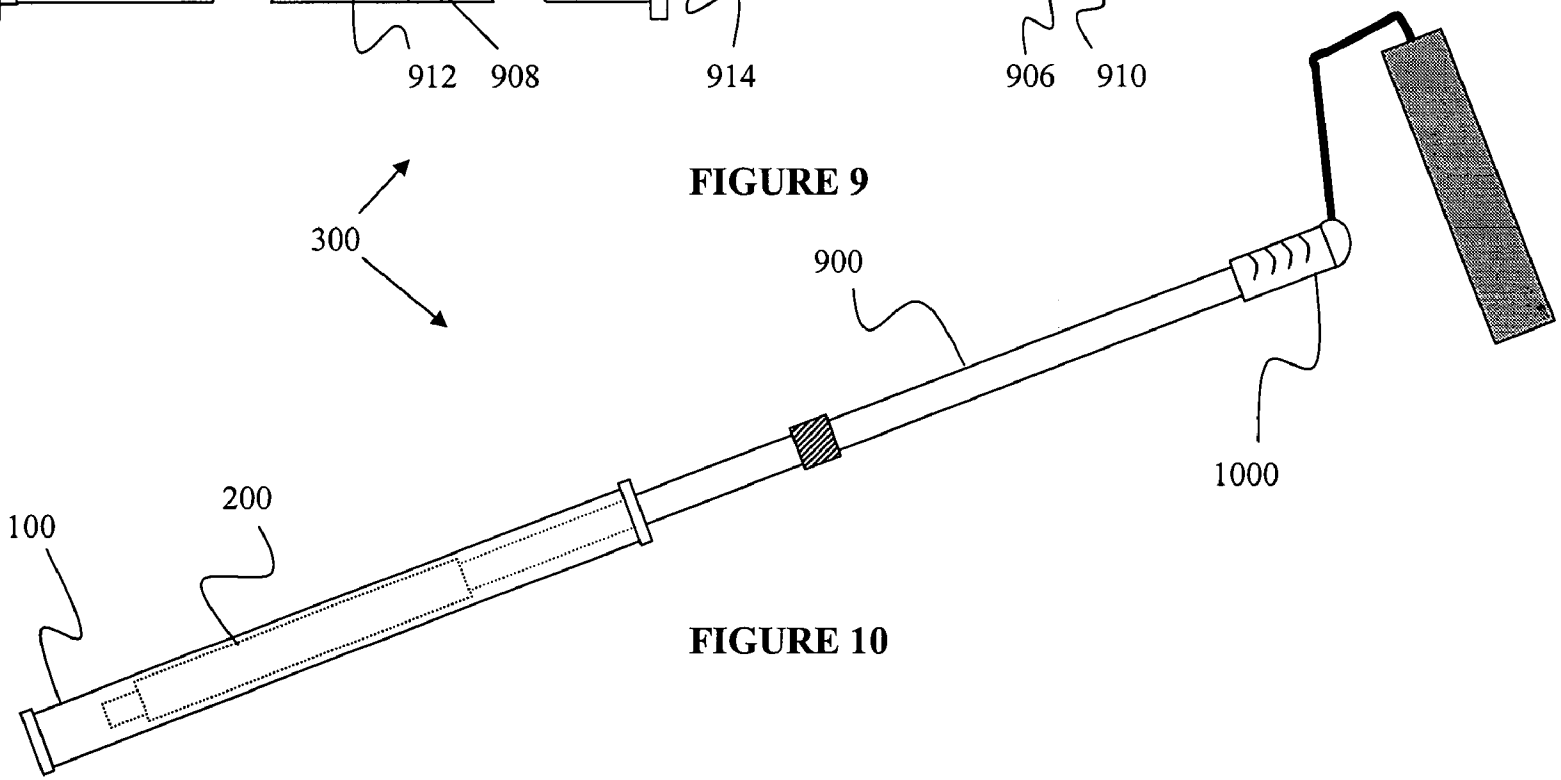
FIG. 10 is an illustration of a side view of a tool attached with a sliding attachment portion of the handle pole.

As shown in FIG. 10, an object such as a tool 1000 may be attached with handle pole 900. When a tool 1000 is attached, a user may reset a fastener by using the end of the apparatus 300 containing the guide member 100 and the impact member 200, or alternatively, the user may turn the apparatus 300 around to utilize the attached tool 1000.

Figure 11:
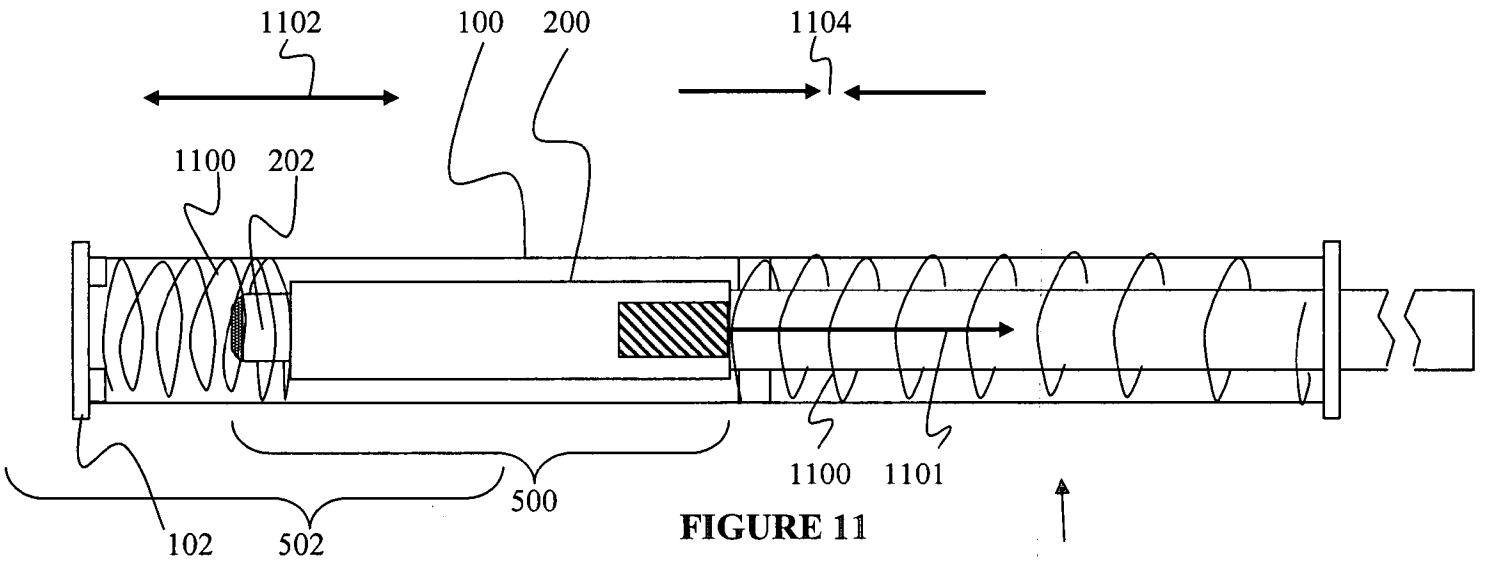
FIG. 11 is an illustration of a cross-sectional side view of a retractor attached with the impact member.

FIG. 11 illustrates another aspect of the apparatus 300 according to the present invention. In this aspect, a retractor 1100 is positioned between the impact member 200 and the guide member 100 such that a retracting force 1101 from the retractor 1100 forces the impact member 200 from the extended position 502 to the retracted position 500. The retractor 1100 may be any suitable mechanism or device that provides a retracting force 1101, a non-limiting example of which includes a spring. For example, if a spring is placed between the distal end 102 and the impact member 200, the spring would create an expansion force 1102, forcing the impact member 200 into the retracted position 500. As an alternative example, if the spring was placed between impact member 200 and the proximal end 104 of the guide member 100, the spring would create a contracting force 1104, thereby pulling the impact member 200 into the retracted position 500.

Figure 12:
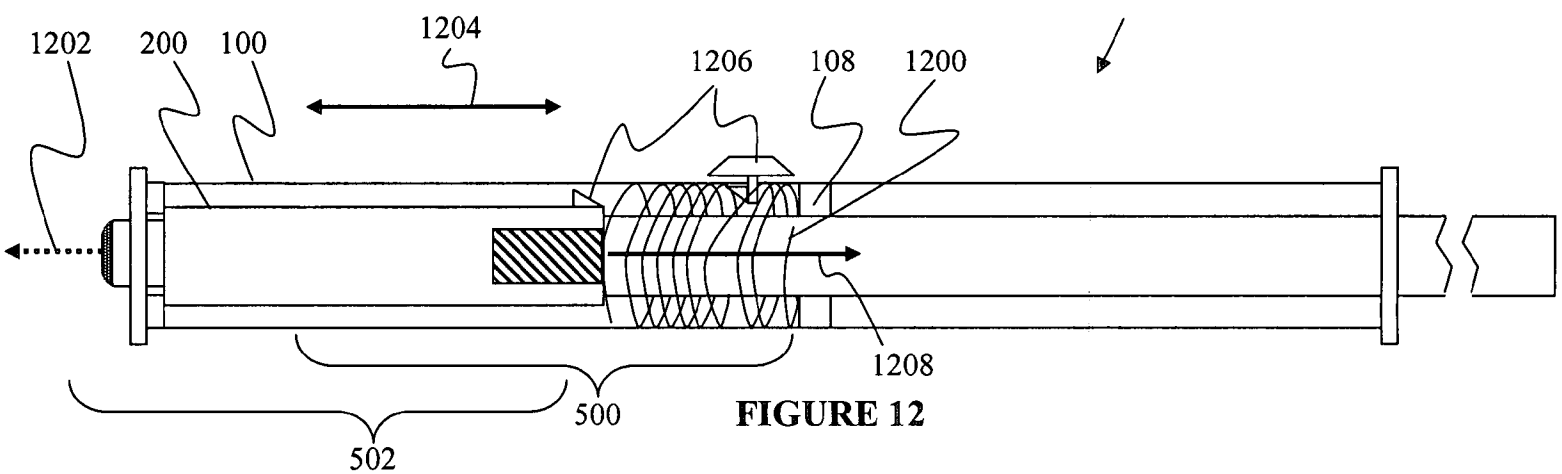
FIG. 12 is an illustration of a cross-sectional side view of an extender attached with the impact member.

FIG. 12 illustrates yet another aspect of the apparatus 300 according to the present invention. In this aspect, an extender 1200 is positioned between the impact member 200 and the guide member 100 such that an extending force 1202 from the extender 1200 forces the impact member 200 from the retracted position 500 to the extended position 502. The extender 1200 may be any suitable mechanism or device that provides an extending force 1202, a non-limiting example of which includes a spring. For example, if a spring is placed between the impact member 200 and the proximal stop 108, the spring would create an expansion force 1204, forcing the impact member 200 from the retracted position 500 to the extended position 502.

A cock and release mechanism 1206 may be attached with apparatus 300. The cock and release mechanism 1206 may be any suitable mechanism or device for holding an object in place and thereafter selecting releasing the object, a non-limiting example of which includes an engageable button, where a bottom side of the button has a wedge shape formed to interact with a corresponding wedge shape on the impact member 200. In this aspect, a user may retract 1208 the impact member 200 where it is held in place by the cock and release mechanism 1206. The user may thereafter release the impact member 200 through use of the same mechanism, where the impact member 200 is thereafter forced to an extended position 502 by the extending force 1202 of the extender 1200.

What is claimed is:

1. An apparatus for resetting a fastener, comprising:

a guide member having a distal end and a proximal end, the guide member further having a length with a guide member axis therethrough, a distal stop positioned proximate the distal end, and a proximal stop positioned proximate the proximal end; and an impact member having a length and an impact member axis residing along the length, where the impact member is attached with the guide member such that the impact member axis is aligned with the guide member axis, the impact member having a striking portion with a striking portion diameter and a proximal portion with a proximal portion diameter where the striking portion diameter is less than the proximal portion diameter, with the impact member positioned between the proximal stop and the distal stop, such that the impact member is freely slideable in relation to the guide member between the proximal stop and the distal stop, the distal stop defining an extended position and the proximal stop defining a retracted position, the extended position occurring when the striking portion of the impact member is extended beyond the distal end of the guide member, and the retracted position occurring when the entirety of the striking portion of the impact member is positioned between the distal end and the proximal end of the guide member: whereby a user may reset a fastener by forcing the impact member from the retracted position to the extended position, where the striking portion of the impact member is then extended beyond the distal end of the guide member to come into contact with the fastener and thereby reset the fastener below a surface plane of a material, wherein the striking portion of the impact member further comprises a head portion with edges, wherein the edges of the head portion are beveled;

wherein the distal end of the guide member further comprises an outer surface and the outer surface further comprises a rubber surface engager attached with the outer surface;

the apparatus further comprising an extender positioned between the impact member and the guide member such that an extending force from the extender forces the impact member from the retracted position to the extended position;

the apparatus further comprising a cock and release mechanism attached with the impact member, whereby a user may retract the impact member where it is held in place by the cock and release mechanism, the user may thereafter release the impact member through use of the same mechanism, where the impact member is thereafter forced to an extended position by the extending force of the extender;

the apparatus further comprising a handle pole attached with proximal portion where the handle pole extends beyond the proximal end of the guide member, the handle pole further having a sliding attachment portion, whereby a user may attach a tool with the sliding attachment portion, allowing the user to reset a fastener through use of the guide member and impact member, or alternatively, turn the apparatus around to utilize the attached tool; and where the handle pole comprises at least two poles, an alignment pole and a sliding pole, where the alignment pole is selectively connected with the sliding pole through use of an adjustment lock.

2. An apparatus for resetting a fastener, comprising:

a guide member having a distal end and a proximal end, the guide member further having a length with a guide member axis therethrough, a distal stop positioned proximate the distal end, and a proximal stop positioned proximate the proximal end; and an impact member having a length and an impact member axis residing along the length, where the impact member is attached with the guide member such that the impact member axis is aligned with the guide member axis, the impact member having a striking portion with a striking portion diameter and a proximal portion with a proximal portion diameter where the striking portion diameter is less than the proximal portion diameter, with the impact member positioned between the proximal stop and the distal stop, such that the impact member is freely slideable in relation to the guide member between the proximal stop and the distal stop, the distal stop defining an extended position and the proximal stop defining a retracted position. the extended position occurring when the striking portion of the impact member is extended beyond the distal end of the guide member, and the retracted position occurring when the entirety of the striking portion of the impact member is positioned between the distal end and the proximal end of the guide member; whereby a user may reset a fastener by forcing the impact member from the retracted position to the extended position, where the striking portion of the impact member is then extended beyond the distal end of the guide member to come into contact with the fastener and thereby reset the fastener below a surface plane of a material.

wherein the striking portion of the impact member further comprises a head portion with edges, wherein the edges of the head portion are beveled:

wherein the distal end of the guide member further comprises an outer surface and the outer surface further comprises a rubber surface engager attached with the outer surface:

the apparatus further comprising a retractor positioned between the impact member and the guide member such that a retracting force from the retractor forces the impact member from the extended position to the retracted position;

the apparatus further comprising a handle pole attached with proximal portion where the handle pole extends beyond the proximal end of the guide member, the handle pole further having a sliding attachment portion, whereby a user may attach a tool with the sliding attachment portion, allowing the user to reset a fastener through use of the guide member and impact member, or alternatively, turn the apparatus around to utilize the attached tool; and where the handle pole comprises at least two poles, an alignment pole and a sliding pole, where the alignment pole is selectively connected with the sliding pole through use of an adjustment lock.

3. An apparatus for resetting a fastener, comprising:

a guide member having a distal end and a proximal end, the guide member further having a length with a guide member axis therethrough, a distal stop positioned proximate the distal end, and a proximal stop positioned proximate the proximal end; and an impact member having a length and an impact member axis residing along the length, where the impact member is attached with the guide member such that the impact member axis is aligned with the guide member axis, the impact member having a striking portion with a striking portion diameter and a proximal portion with a proximal portion diameter where the striking portion diameter is less than the proximal portion diameter, with the impact member positioned between the proximal stop and the distal stop, such that the impact member is freely slideable in relation to the guide member between the proximal stop and the distal stop, the distal stop defining an extended position and the proximal stop defining a retracted position, the extended position occurring when the striking portion of the impact member is extended beyond the distal end of the guide member, and the retracted position occurring when the entirety of the striking portion of the impact member is positioned between the distal end and the proximal end of the guide member; whereby a user may reset a fastener by forcing the impact member from the retracted position to the extended position, where the striking portion of the impact member is then extended beyond the distal end of the guide member to come into contact with the fastener and thereby reset the fastener below a surface plane of a material;

the apparatus further comprising a handle pole attached with proximal portion where the handle pole extends beyond the proximal end of the guide member, the handle pole further having a sliding attachment portion, whereby a user may attach a tool with the sliding attachment portion, allowing the user to reset a fastener through use of the guide member and impact member, or alternatively, turn the apparatus around to utilize the attached tool;

wherein the handle pole comprises at least two poles, an alignment pole and a sliding pole, where the alignment pole is selectively connected with the sliding pole through use of an adjustment lock.

* * * * *